US012709965B2

(12) United States Patent
Gartz et al.

(10) Patent No.: US 12,709,965 B2
(45) Date of Patent: Aug. 18, 2026

(54) SHOCK RESISTANT PERFORATING TOOL FOR MULTIZONE COMPLETIONS

(71) Applicant: Owen Oil Tools LP, Houston, TX (US)

(72) Inventors: Jeffrey Gartz, Lacombe (CA); Timothy E. Lagrange, Lacombe (CA); Bradley Vass, Fort Worth, TX (US)

(73) Assignee: Owen Oil Tools LP, Houston, TX (US)

( * ) Notice: Subject to any disclaimer, the term of this patent is extended or adjusted under 35 U.S.C. 154(b) by 0 days.

(21) Appl. No.: 18/038,975

(22) PCT Filed: Nov. 25, 2021

(86) PCT No.: PCT/US2021/060380

§ 371 (c)(1),
(2) Date: May 25, 2023

(87) PCT Pub. No.: WO2022/115389

PCT Pub. Date: Jun. 2, 2022

(65) Prior Publication Data

US 2024/0003231 A1 Jan. 4, 2024

Related U.S. Application Data

(60) Provisional application No. 63/118,423, filed on Nov. 25, 2020.

(51) Int. Cl.
*F42D 1/04* (2006.01)
*E21B 17/07* (2006.01)
(Continued)

(52) U.S. Cl.
CPC ..... *E21B 43/1185* (2013.01); *E21B 17/07* (2013.01); *F42D 1/04* (2013.01); *E21B 43/14* (2013.01)

(58) Field of Classification Search
CPC ..... F42B 1/04; F42B 3/26; E21B 43/1185; E21B 17/07; F42D 1/04; F42D 1/00
See application file for complete search history.

(56) References Cited

U.S. PATENT DOCUMENTS 2,935,944 A 5/1960 Sweetman
4,825,764 A * 5/1989 Jullien ..... F42D 1/043 102/275.12

(Continued)

FOREIGN PATENT DOCUMENTS

CN 107355202 B 8/2019
WO 2012006357 A2 1/2012
WO 2017139656 A1 8/2017

OTHER PUBLICATIONS

PCT/US2021/060380; International Search Report dated Mar. 11, 2022; 4pp.

*Primary Examiner* — J. Woodrow Eldred
(74) *Attorney, Agent, or Firm* — Crowe & Dunlevy, P.C.

(57) ABSTRACT

An apparatus for perforating a wellbore includes a plurality of perforator units that includes a first perforator unit and a second perforator unit; and a signal transfer module connecting the first perforator unit to the second perforator unit. The signal transfer module includes an enclosure having a bore, an input end, and an output end, an initiator positioned adjacent to the first perforator unit and at least partially in the enclosure, an initiator, an igniter, a fuse, and an isolator. The initiator generates a shock wave when initiated. The igniter is positioned in the enclosure and generates a low order output upon receiving the shock wave generated by the initiator. The fuse is positioned in the enclosure and is initiated by the low order output of the igniter. The fuse outputs a high order output from the output end of the enclosure. The isolator secures the fuse body in the bore of the enclosure. The isolator includes a shock attenuator. Only (Continued)

the shock attenuator physically connects the fuse to the enclosure.

12 Claims, 3 Drawing Sheets

(51) Int. Cl.
*E21B 43/1185* (2006.01)
*E21B 43/14* (2006.01)

(56) References Cited

U.S. PATENT DOCUMENTS

| | | | | |
|---|---|---|---|---|
| 11,098,563 | B1 | 8/2021 | Ludwig | |
| 2013/0014990 | A1 | 1/2013 | Barton et al. | |
| 2016/0273902 | A1 | 9/2016 | Eitschberger | |
| 2019/0048693 | A1* | 2/2019 | Henke | E21B 43/11855 |
| 2021/0198983 | A1* | 7/2021 | Eitschberger | E21B 43/117 |
| 2021/0332677 | A1* | 10/2021 | Grove | C06C 7/00 |

* cited by examiner

SHOCK RESISTANT PERFORATING TOOL FOR MULTIZONE COMPLETIONS

TECHNICAL FIELD

The present disclosure relates to devices and method for perforating a subterranean formation.

BACKGROUND

Hydrocarbons, such as oil and gas, are produced from cased wellbores intersecting one or more hydrocarbon reservoirs in a formation. These hydrocarbons flow into the wellbore through perforations in the cased wellbore. Perforations are usually made using a perforating perforator unit that is generally comprised of a steel tube "carrier," a charge tube riding on the inside of the carrier, and with shaped charges positioned in the charge tube. The perforator unit is lowered into the wellbore on electric wireline, slickline, tubing, coiled tubing, or other conveyance device until it is adjacent to the hydrocarbon producing formation. Thereafter, a surface signal actuates a firing head associated with the perforating perforator unit, which then detonates the shaped charges. Projectiles or jets formed by the explosion of the shaped charges penetrate the casing to thereby allow formation fluids to flow through the perforations and into a production string.

In wells that have long or substantial gaps between zones, an operator may use two or more spaced apart perforator units. Each perforator unit may be positioned adjacent a zone to be perforated. Conventional perforators having two or more perforator units are sometimes prone to failure because the shock associated with the firing of one perforator unit can interfere with or unintentionally cause the firing of other perforator units. The present disclosure addresses the need for shock resistant perforators as well as other needs of the prior art.

SUMMARY

In aspects, the present disclosure provides an apparatus for perforating a wellbore. The apparatus may include a plurality of perforator units having at least a first perforator unit and a second perforator unit, and a signal transfer module connecting the first perforator unit to the second perforator unit. The signal transfer module may include an enclosure having a bore, an input end, and an output end, an initiator positioned adjacent to the first perforator unit and at least partially in the enclosure, the initiator configured to generate a shock wave when initiated, an igniter positioned in the enclosure and adjacent to the initiator, the igniter configured to generate a low order output upon receiving the shock wave generated by the initiator, a fuse positioned in the enclosure and configured to be initiated by the low order output of the igniter, the fuse outputting a high order output from the output end of the enclosure, and an isolator securing the fuse body in the bore of the enclosure, wherein the isolator includes at least one shock attenuator, wherein only the at least one shock attenuator physically connects the fuse to the enclosure.

It should be understood that certain features of the invention have been summarized rather broadly in order that the detailed description thereof that follows may be better understood, and in order that the contributions to the art may be appreciated. There are, of course, additional features of the invention that will be described hereinafter and which will in some cases form the subject of the claims appended thereto.

BRIEF DESCRIPTION OF THE DRAWINGS

For detailed understanding of the present disclosure, references should be made to the following detailed description taken in conjunction with the accompanying drawings, in which like elements have been given like numerals and wherein.

DETAILED DESCRIPTION

Figure 1:
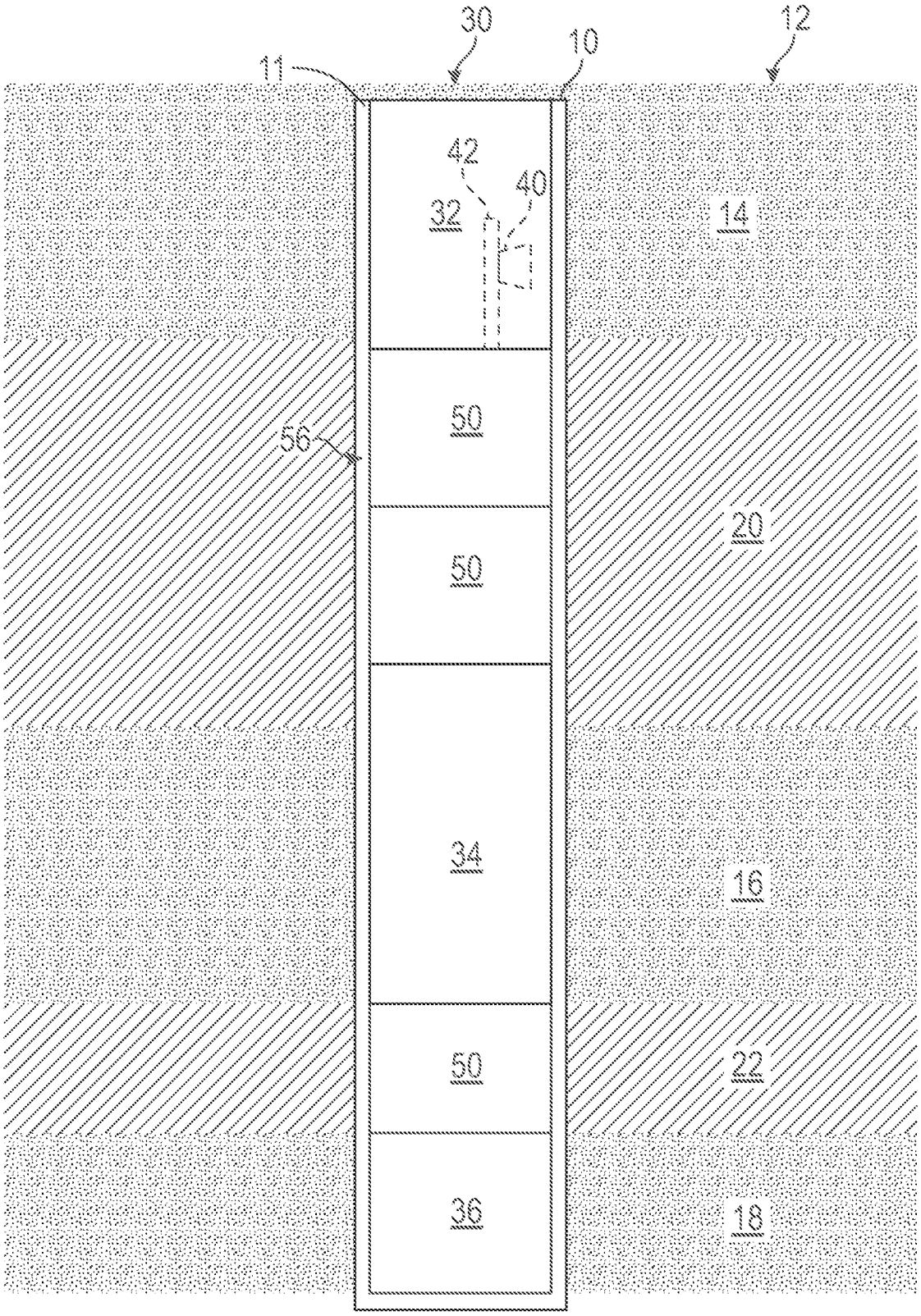
FIG. 1 schematically illustrates a side sectional view of a perforating tool according to one embodiment of the present disclosure.

The present disclosure relates to devices and methods for perforating a formation intersected by a wellbore. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring to FIG. 1, there is shown a wellbore 10 drilled in a subterranean formation 12 having multiple production zones 14, 16, 18. The zones are separated by layers 20, 22 of different thicknesses. The production zones 14, 16, 18 may be perforated by using a perforating tool 30 that includes perforator units 32, 34, 36. The perforator units 32, 34, 36 may include known components such as one or more shaped charges 40 and associating detonating devices such as detonating cords 42.

In accordance with the present disclosure, the perforating tool 30 may include signal transfer modules 50 to transfer a firing signal between adjacent perforator units, i.e., between perforator units 32 and 34 and between perforator units 34 and 36. Generally, in response to a firing of one perforator unit, a detonation transfer module 50 transmits a firing signal that can initiate the firing of an adjacent perforator unit. For brevity, the description below refers to a firing sequence wherein a firing signal travels from "upper" perforator units to "lower" perforator units. It should be understood that firing signals can also travel from "lower" perforating units to "upper" perforating units in other firing sequences.

Figure 2:
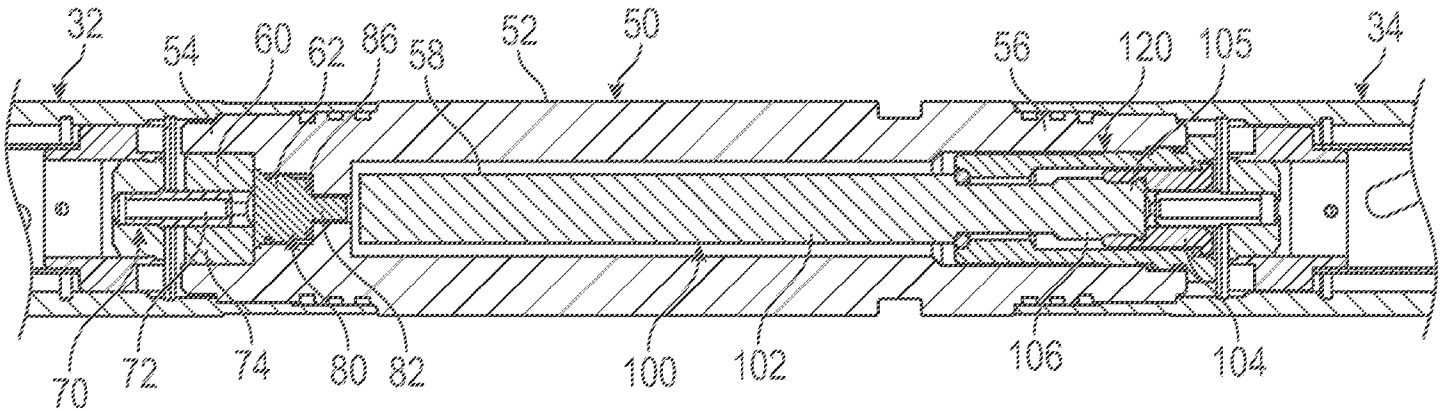
FIG. 2 schematically illustrates a signal transfer module in accordance with one embodiment of the present disclosure that uses an explosive charge.

Referring now to FIG. 2, there is a shown one non-limiting embodiment of a signal transfer module 50 in accordance with the present disclosure. The module 50 is configured to respond to the firing of the upper perforator unit 32 by initiating the firing of the lower perforator unit 34. By "respond," it is meant that the module 50 is directly or indirectly energized and activated by the energy released upon firing of the upper perforator unit 32. The energy is principally a high order detonation, i.e., includes a shock wave and heat. In embodiments, the signal transfer module 50 may be configured to provide a predetermined time delay between the firing of the upper perforator unit 32 and the lower perforator unit 34.

The signal transfer module 50 may include an enclosure 52 having an input end 54 connected to the upper perforator unit 32 and an output end 56 connected to the lower perforator unit 34. A bore 58 extending through the enclosure 52 may be formed of different sized cavities and openings as discussed below. The signal transfer module 50 also includes an initiator 70, an igniter 80, a fuse 100, and an isolator 120.

The initiator 70 may include an energetic body 72 secured in a case 74. The energetic body 72 may be formed of an energetic material that can be initiated by the firing of a perforator unit, e.g., the perforator unit 32. For example, the energetic body 72 may be a bidirectional booster charge that outputs a high order detonation when activated. The case 74 may be formed as a disk or tubular member that is threaded or is otherwise secured in an opening 60 of the bore 58. In some embodiments, the case 74 may include one or more sealing members (not shown) that block the flow of fluids, such as wellbore liquids, along the bore 58. The seal may be present before and after firing of the upper and the lower guns 32, 34. That is, a case 74 has one or more sealing members (not shown) that maintain pressure and fluid isolation between the interior of the guns 32, 34 before and after the perforating activity. An initiator 70 having such a structure and associated functionality may be referred to as a sealed initiator 70. As shown, the initiator 70 may be at least partially disposed in the enclosure 52. That is, a portion of the initiator 70 may extend outside of the enclosure 52 to facilitate an energetic connection with the adjacent perforating unit 32. By energetic connection, it is meant a connection that enables the transmission of energy sufficient to activate the initiator 70.

The igniter 80 may include a case 82 in which is disposed a quantity of energetic material (not shown) and one or more seals 86. The igniter 80 may be positioned in a cavity 62 in communication with the opening 60. The energetic material may be formulated to generate a low order detonation when initiated by the high order detonation of the initiator 70. The seals 86 provide a fluid-tight seal within the cavity 62 such that fluid cannot flow via the cavity 62 between the signal transfer module 50 and the upper perforator 32.

In embodiments, the initiator 70 and igniter 80 are configured to interact principally through a non-projectile activation. Instead, detonation energy from the initiator 70 consists mainly of shock waves (supersonic sound waves) and thermal energy that can activate the igniter 80. Thus, it should be understood that kinetic energy, such as that associated with movement of a pin or projectile, is not used to activate the igniter 80. It should be appreciated that the igniter 80 is not susceptible to activation if subjected to a shock and/or vibrations. For brevity, the term "shock" refers to both pulsed movement, i.e., a singular or short-duration movement, as well as continuous movements, i.e., vibrations. Such shocks can occur due to movement of the perforating tool 30 through the wellbore 10 (FIG. 1) or due to the unrelated firing of perforating units.

In a non-limiting embodiment, the fuse 100 may include an energetic body 102 and a holder 104. The energetic body 102 may be a cylindrical member as shown or have any other suitable shape. The energetic body 102 may include an energetic material, discussed in greater detail below, which is activated by the low order output of the igniter 80. The holder 104 may be a clip, clamp, or other fixture that rigidly attaches to the energetic body 102. In one arrangement, the holder 104 may be a tubular member such as a sleeve that threads or is otherwise affixed to an end 106 of the energetic body 102. As a non-limiting example, the holder 104 may have an internally threaded bore 105 into which the end of the energetic body 102 is threaded. If a secure connection is not needed, the internal threads may be omitted. Also, non-mechanical connections such as adhesives may be used.

The energetic body 102 may include a combination of energetic materials, each of which exhibit different burn characteristics, e.g., the type or rate of energy released by that material. By appropriately configuring the chemistry, volume, and positioning of these energetic materials, a desired or predetermined time delay can be in the firing sequence. Generally, the energetic materials can include materials such as RDX, HMX that provides a high order detonation and a second energetic material that provides a low order detonation. The burn rate of an energetic material exhibiting a high order detonation, or high order detonation material, is generally viewed as instantaneous, e.g., on the order of microseconds or milliseconds. The burn rate of an energetic material exhibiting a low order detonation, or low order detonation material, may be on the order of seconds. In some conventions, the high order detonation is referred to simply as a detonation and the low order detonation is referred to as a deflagration. The energetic body 102 may be formulated to provide a predetermined time delay in the order of minutes (e.g., 5 minutes, 10 minutes, 15 minutes, etc.) or hours (1 hour, 2 hours, etc.).

In some embodiments, the energetic body 102 of the fuse 100 may be susceptible to activation if subjected to a shock and/or vibrations. Such an activation may be undesirable because shocks can occur due to movement of the perforating tool 30 through the wellbore 10 (FIG. 1) or due to the unrelated firing of perforating units.

As discussed above, the initiator 70 and igniter 80 interact principally through a non-projectile activation. Therefore, there is no risk that movement of the perforating tool 30 or unrelated firings will cause a pin to unintentionally move and active the igniter 80.

Figure 3:
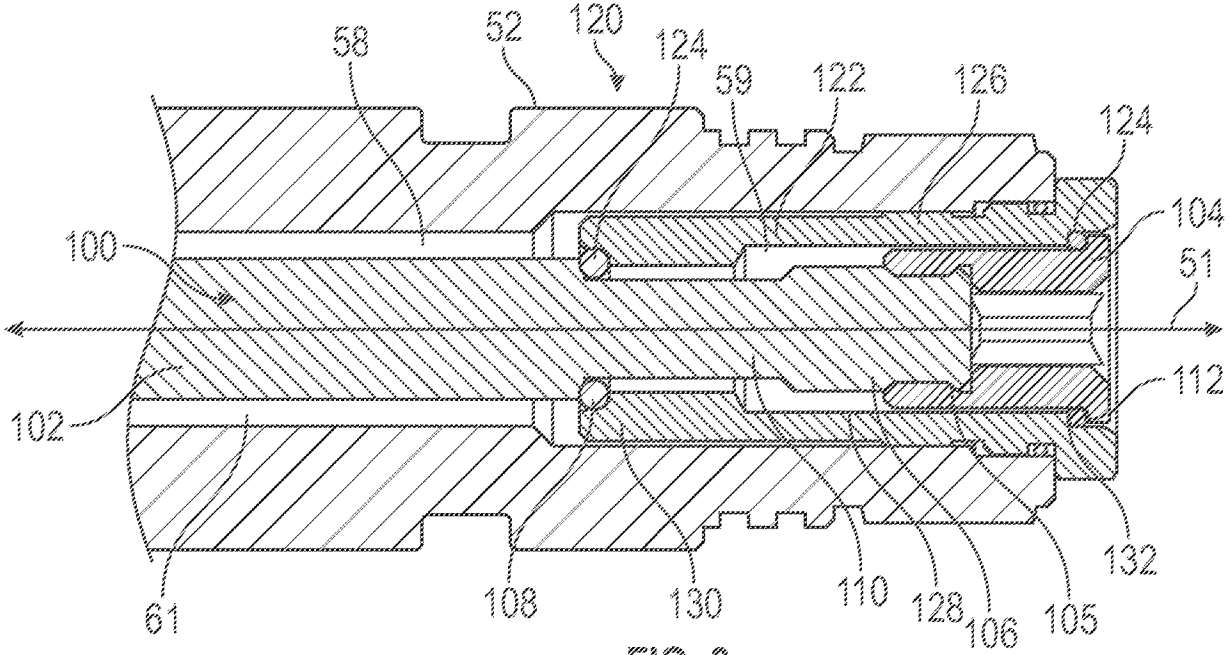
FIG. 3 schematically illustrates an isolator in accordance with one embodiment of the present disclosure.

Further, referring to FIG. 3, to prevent an unintended event from initiating the fuse body 102, the isolator 120 may be configured to attenuate the transmission of shock and/or vibrations along motion transmitting connections between the enclosure 52 and the fuse 100. The attenuation of the shock and/or vibration is great enough that the magnitude of shock and/or vibration that ultimately acts on the fuse 100 is insufficient to activate the fuse 100.

In one non-limiting embodiment, the isolator 120 secures the fuse 100 within the bore 58 of the enclosure 52 such that no surface of the fuse 100 directly contacts an inner surface 59 that defines the bore 58 of the enclosure 52. The isolator 120 may include a plug 122 and one or more shock attenuators 124. The plug 122 may connect to the enclosure 52 via a suitable connector such as threads 126. In the FIG. 3 embodiment, there are only two physical connections that are capable of transmitting motion from the enclosure 52 to the fuse 100, the "motion transmitting connections," and that traverse a gap 61 between the fuse 100 and the enclosure 52: a first motion transmitting connection formed by the plug 122 and the shock attenuator 124 and a second motion transmitting connection formed by the holder 104, the shock attenuator 124, and the plug 122. Thus, shock attenuators 124 are positioned along every motion transmitting connection to reduce the magnitude of shock/vibrations transferred from the enclosure 52 to the fuse body 102.

For purposes the present disclosure, a shock attenuator 124 is an element, body, or assembly that has an effective modulus of elasticity between 2 MPA and 60 MPA (300 PSI to 9000 PSI) at standard room temperature. Shock attenuators may include materials having the desired modulus of elasticity: e.g., non-metals such as rubber, elastomers, viscoelastic materials, and plastics. These materials may be formed as pads, rings, or other bodies having any desired shape, dimension, or geometry. Assemblies using springs, whether formed of metal or non-metal, may be configured to provide attenuation that simulates a modulus of elasticity between 2 MPA and 60 MPA. In still other arrangements, hydraulic liquids may be used to simulate a modulus of elasticity between 2 MPA and 60 MPA (300 PSI to 9000 PSI).

In the illustrated embodiment, the fuse 100 and the isolator 120 are secured to one another using resilient compression. This resilient compression may be obtained by threading the holder 104 onto the end of the energetic body 102. The fuse body 102 may include a first shoulder 108 adjacent to a reduced-diameter section 110 of the end 106 of the fuse body 102. The holder 104 may include an opposing second shoulder 112. The plug 122 may include an inner surface 128 that includes a first wall 130 axially opposed to and adjacent to the first shoulder 108 and a second wall 132 axially opposed to adjacent to the second shoulder 112. By axially opposed, it is meant that shoulders 108, 112 can physically contact the respectively adjacent walls 130, 132 when moving parallel to a long axis 51 of the enclosure 52. This parallel movement may be caused by the threading of the holder 104 onto the end of the energetic body 102 as mentioned previously. At least one shock attenuator 124 is positioned between and physically contacts the shoulder 108 and the wall 130 and between and physically contacts the shoulder 112 and the wall 132. The shock attenuators 124 physically separate the shoulders 108, 112 from their respective adjacent walls 130, 132. Thus, the shock attenuators 124 present in every structure that physically contacts the fuse 100 and the plug 122 and therefore can attenuate shock/vibrations along every physical connection between the enclosure 52 and the fuse 100. While there may be incidental contact between the plug 122 and/or the enclosure 52 and the fuse body 102, such contact does not transfer shock or vibrations at a magnitude that can initiate the fuse body 102.

Figure 4A:
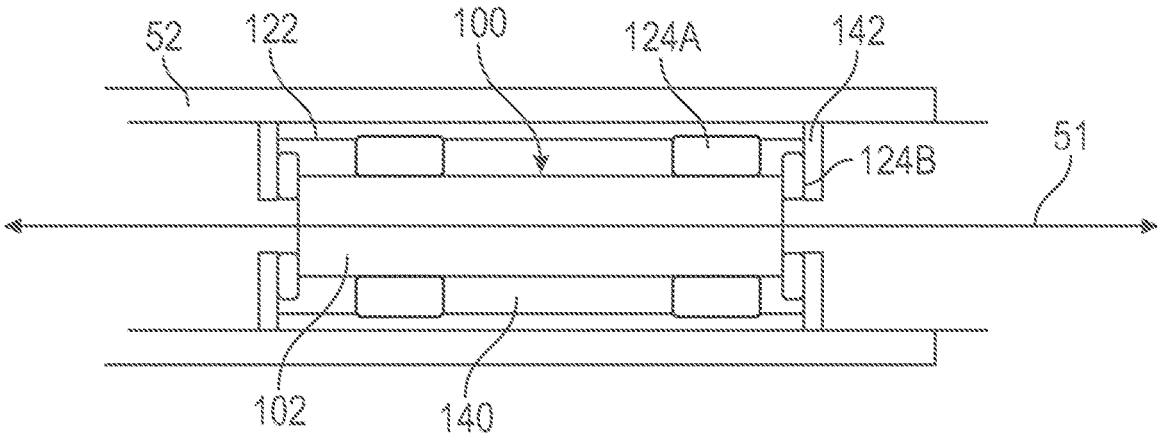
FIGS. 4A-B schematically illustrates fuses and isolators in accordance embodiments of the present disclosure.
Figure 4B:
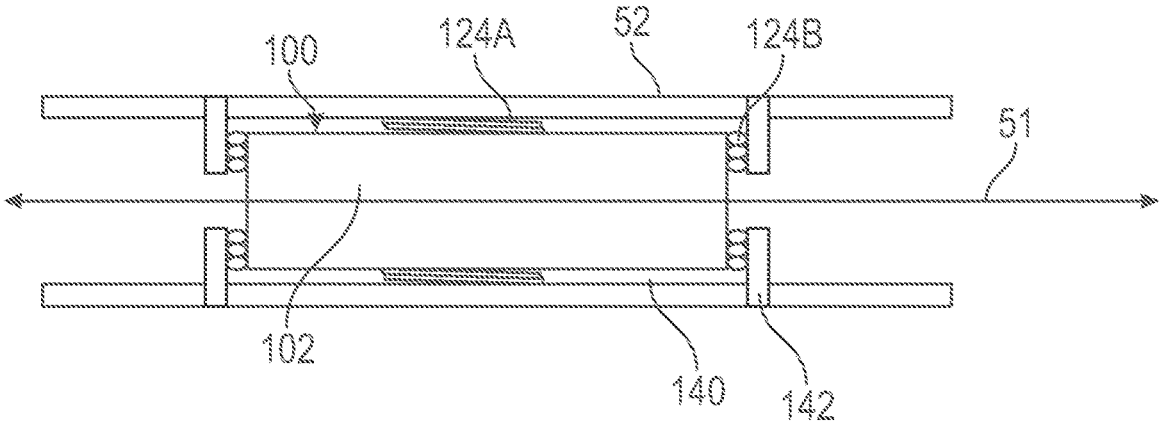

The fuse 100 and the isolator 120 are susceptible to numerous variations. For example, in FIG. 3, some embodiments may utilize only one shock attenuator 104 by using a securing arrangement other than a threaded connection, e.g., adhesives. Other variants are shown in FIGS. 4A-B. In FIGS. 4A-B, a fuse 100 that includes a fuse body 102 is supported by shock attenuators 124A,B. It should be noted that, like in FIG. 3, shock attenuators 124 are positioned along every motion transmitting connection that traverses the gap 61 to reduce the amount of shock/vibrations transferred from the enclosure 52 to the fuse body 102. In non-limiting arrangements, the shock attenuators 124A,B may be rings. It should be noted that a holder 104 (FIG. 2) is not used in either embodiment. The shock attenuators 124A,B support the fuse body 102 such that no surface of the fuse body 102 physically contacts a surface not belonging to the shock attenuators 124A,B. Thus, a physical gap 140 separates the fuse body 102 from all non-shock attenuator 124A,B surfaces. The shock attenuators 124A are configured to attenuate shock in a direction transverse to the long axis 51 and the shock attenuators 124B are configured to attenuate shock in a direction parallel to the long axis 51. It should be noted that in arrangements having sufficient compression, an arrangement may have only one shock attenuator, e.g., shock attenuator 124A or 124B.

In the FIG. 4A embodiment, the shock attenuators 124A,B are used with a plug 122 that seats within the enclosure 52. The shock attenuators 124A,B may be solid or may be particulates solids or fluids (liquids or gas) captured in suitable containers such as capsules. A cap 142 secures the fuse body 102 within the plug 122. In the FIG. 4B embodiment, the shock attenuators 124A,B physically and directly connect the fuse body 102 to the enclosure 52. Thus, no plug 122 (FIG. 4A) is used. In this embodiment, the shock attenuators 124A,B may be springs or other similar biasing elements. It should be noted that in arrangements having sufficient compression, an arrangement may have only one shock attenuator, e.g., shock attenuator 124A or 124B.

Still another variant is illustrated in FIG. 1. As shown, in some embodiments, a single signal transfer module 50 may interconnect two perforating units (e.g., perforating units 34 and 36). In other embodiments, a set 56 of signal transfer modules 50 may interconnect two perforating units (e.g., perforating units 32 and 34).

Referring to FIGS. 1-4B, in an exemplary mode of operation, the perforating tool 30 may be conveyed along the wellbore 10 toward a desired target depth. During such motion, the perforating tool 30 may encounter vibrations and other disruptive motion. Because the initiator 70 and the igniter 80 do not operatively interact through physical contact, such as impingement by a pin, the likelihood of an inadvertent activation of the perforating tool 30 is minimized. Further, because the shock attenuators 124 minimize, if not eliminate, detrimental contact between the fuse body 102 and surfaces of the enclosure 52, the likelihood of an inadvertent activation of the perforating tool 30 due to such contact is minimized. When positioned at the desired target depth, the upper perforating unit 32 may be fired. A detonation associated with the firing of the upper perforating unit 32 activates the initiator 70, which generates a high order detonation that activates the igniter 80. The igniter 80 subsequently generates a low order detonation that activates the fuse 100. The fuse 100 ignites and burns at a rate that provides the desired time delay. Upon the fuse 100 completing its burn, the fuse 100 outputs a high order detonation that activates and fires the lower perforating unit 34.

In another mode of operation, there may be two or more desired target depths and the perforating tool 30 may be moved between the desired target depths. For example, after positioned at the desired target depth, the upper perforating unit 32 may be fired. A detonation associated with the firing of the upper perforating unit 32 activates the initiator 70, which generates a high order detonation that activates the igniter 80. The igniter 80 subsequently generates a low order detonation that activates the fuse 100. The fuse 100 ignites and burns at a rate that provides the desired time delay. While the fuse 100 burns, the perforating tool 30 is moved to the next target depth. The desired time delay allows the perforating tool 30 to be moved to and set at the next desired depth. Beneficially, the shock attenuation features of the present disclosure minimize the risk of such movement causing an unintended detonation. Upon the fuse 100 completing its burn, the fuse 100 outputs a high order detonation that activates and fires the lower perforating unit 34.

As used above, a high-order detonation is a detonation that produces high amplitude pressure waves (e.g., supersonic shock waves) and thermal energy. Likewise, a high-order explosive is an explosive formulated to generate a high-order detonation when detonated. In firing head assemblies, a high-order detonation occurs when a firing pin percussively impacts and detonates a detonator that includes a high-order explosive. The primary and secondary explosive bodies, as well as the activator, may use one or more high-explosives. Illustrative high-explosives include, but are not limited, to RDX (Hexogen, Cyclotrimethylenetrinitramine), HMX (Octagon, Cyclotetramethylenetetranitramine), HNS, and PYX.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. An apparatus for perforating a wellbore, comprising:

a plurality of perforator units that includes at least a first perforator unit and a second perforator unit; and a signal transfer module connecting the first perforator unit to the second perforator unit, the signal transfer module including:

an enclosure having a bore, an input end, and an output end, an initiator positioned adjacent to the first perforator unit and at least partially in the enclosure, the initiator configured to generate a shock wave when initiated, an igniter positioned in the enclosure and adjacent to the initiator, the igniter configured to generate a low order detonation upon receiving the shock wave generated by the initiator, wherein the initiator and the igniter are configured to interact principally through a non-projectile activation, a fuse positioned in the enclosure and configured to be initiated by the low order detonation of the igniter, the fuse outputting a high order detonation from the output end of the enclosure, and, an isolator securing the fuse in the bore of the enclosure using at least one motion transmitting connection, wherein every motion transmitting includes at least one shock attenuator, wherein the at least one shock attenuator attenuates at least one of: shock and vibration, and wherein the attenuation is at least enough to prevent activation of the fuse.

2. The apparatus of claim 1, further comprising a holder receiving an end of the fuse, wherein the isolator includes a plug connected to the enclosure, wherein a gap separates the fuse from an inner surface of the enclosure, wherein the at least one shock attenuator includes a first shock attenuator and a second shock attenuator, and wherein the at least one motion transmitting connection includes:

a first motion transmitting connection formed by the plug and the first shock attenuator; and a second motion transmitting connection formed by the holder, the second shock attenuator, and the plug.

3. The apparatus of claim 1, wherein the isolator includes a plug into which a portion of the fuse is received, wherein the plug is connected to the enclosure, and wherein the at least one shock attenuator connects to the plug.

4. The apparatus of claim 1, wherein the at least one shock attenuator includes a first shock attenuator and a second shock attenuator.

5. The apparatus of claim 1, wherein the initiator is a sealed initiator.

6. A method for perforating a wellbore, comprising:

conveying a perforating tool along the wellbore toward a desired target depth, wherein the perforating tool includes:

a plurality of perforator units that includes at least a first perforator unit and a second perforator unit; and a signal transfer module connecting the first perforator unit to the second perforator unit, the signal transfer module including:

an enclosure having a bore, an input end, and an output end, an initiator positioned adjacent to the first perforator unit and at least partially in the enclosure, the initiator configured to generate a shock wave when initiated, an igniter positioned in the enclosure and adjacent to the initiator, the igniter configured to generate a low order detonation upon receiving the shock wave generated by the initiator wherein the initiator and the igniter are configured to interact principally through a non-projectile activation, a fuse positioned in the enclosure and configured to be initiated by the low order detonation of the igniter, the fuse outputting a high order detonation from the output end of the enclosure, and, an isolator securing the fuse in the bore of the enclosure using at least one motion transmitting connection, wherein every motion transmitting connection includes at least one shock attenuator;

minimizing detrimental contact between the fuse and the enclosure using the at least one shock attenuator, wherein the at least one shock attenuator attenuates at least one of: shock and vibration, wherein the attenuation is at least enough to prevent activation of the fuse, the attenuation minimizing detrimental contact between the fuse and the enclosure using the at least one shock attenuator;

positioning the perforating tool at the desired target depth; and firing the perforating tool.

7. The method of claim 6, further comprising a holder receiving an end of the fuse, wherein the isolator includes a plug connected to the enclosure, wherein a gap separates the fuse from an inner surface of the enclosure, wherein the at least one shock attenuator includes a first shock attenuator and a second shock attenuator, and wherein the at least one motion transmitting connection includes:

a first motion transmitting connection formed by the plug and the first shock attenuator; and a second motion transmitting connection formed by the holder, the second shock attenuator, and the plug.

8. The method of claim 6, wherein the isolator includes a plug into which a portion of the fuse is received, wherein the plug is connected to the enclosure, and wherein the at least one shock attenuator connects to the plug.

9. The method of claim 6, wherein the at least one shock attenuator includes a first shock attenuator and a second shock attenuator.

10. The method of claim 6, wherein the initiator is a sealed initiator.

11. The apparatus of claim 1, wherein the at least one shock attenuator has an effective modulus of elasticity between 2 MPA and 60 MPA (300 PSI to 9000 PSI) at standard room temperature.

12. The method of claim 6, wherein the at least one shock attenuator has an effective modulus of elasticity between 2 MPA and 60 MPA (300 PSI to 9000 PSI) at standard room temperature.

* * * * *